US008410705B2

(12) United States Patent
Bollmann et al.

(10) Patent No.: US 8,410,705 B2
(45) Date of Patent: Apr. 2, 2013

(54) LED LIGHTING SYSTEM WITH BYPASS CIRCUIT FOR FAILED LED

(75) Inventors: Klaus Bollmann, Horseshoe Bay, TX (US); Tom C. Penick, Leander, TX (US)

(73) Assignee: Ringdale, Inc., Georgetown, TX (US)

( * ) Notice: Subject to any disclaimer, the term of this patent is extended or adjusted under 35 U.S.C. 154(b) by 265 days.

(21) Appl. No.: 12/621,438

(22) Filed: Nov. 18, 2009

(65) Prior Publication Data

US 2010/0123399 A1 May 20, 2010

Related U.S. Application Data

(60) Provisional application No. 61/115,775, filed on Nov. 18, 2008, provisional application No. 61/149,076, filed on Feb. 2, 2009.

(51) Int. Cl.
*H05B 37/00* (2006.01)

(52) U.S. Cl. ..... 315/119; 315/122; 315/185 R

(58) Field of Classification Search ..... 315/119, 315/122, 185 R, 188, 192, 291; 361/91.5, 361/91.6

See application file for complete search history.

(56) References Cited

U.S. PATENT DOCUMENTS

| | | | | | |
|---|---|---|---|---|---|
| 3,573,550 | A * | 4/1971 | Baker, Jr. | ..... | 361/56 |
| 3,967,257 | A * | 6/1976 | Hager | ..... | 340/664 |
| 4,165,475 | A * | 8/1979 | Pegg et al. | ..... | 315/99 |
| 5,650,904 | A * | 7/1997 | Gilley et al. | ..... | 361/56 |
| 7,262,752 | B2 * | 8/2007 | Weindorf | ..... | 345/82 |
| 7,564,666 | B2 * | 7/2009 | Ball et al. | ..... | 361/91.5 |
| 7,800,316 | B2 * | 9/2010 | Haug | ..... | 315/299 |
| 7,994,725 | B2 * | 8/2011 | Bouchard | ..... | 315/122 |
| 2005/0018726 | A1 * | 1/2005 | Dinger et al. | ..... | 372/38.09 |
| 2009/0323238 | A1 * | 12/2009 | Gehrke | ..... | 361/56 |
| 2010/0156298 | A1 * | 6/2010 | Takacs et al. | ..... | 315/90 |

* cited by examiner

*Primary Examiner* — Tung X Le
(74) *Attorney, Agent, or Firm* — Hulsey, P.C.; Loren T. Smith; Christina Saenz

(57) ABSTRACT

A bypass circuit is provided for each LED in a series to permit continued operation with reduced lighting in the event of an LED failure. The bypass circuit is provided in parallel to the LED and comprises a Zener Diode provided in parallel to a thyristor. Upon LED failure, the voltage across the Zener Diode is increased thereby triggering the thyristor which is maintained in a triggered mode as long as current flows through the series circuit.

10 Claims, 4 Drawing Sheets

LED LIGHTING SYSTEM WITH BYPASS CIRCUIT FOR FAILED LED

This application is related to U.S. Provisional Patent Application No. 61/115,775 filed Nov. 18, 2008, and claims the priority date of that provisional patent application;; and is related to U.S. Provisional Patent Application No. 61/149,076 filed Dec. 14, 2008.

BACKGROUND

1. Field of Invention

This application is related to LED lighting, and more specifically to a system and method for providing continued operation in the event that an LED in series with other LEDs fails.

2. Prior Art

Most LED lighting arrangements have a number of LEDs in series. Although LEDs, in general, are reliable for extended periods of time, failures are known to happen. If one LED fails and becomes an open circuit, then the others in series with that LED will also fail because no current can flow.

SUMMARY OF INVENTION

The essence of the invention is to detect the failure of an LED and to shunt the open circuit LED so that the other LEDs can still function and produce the maximum possible light output. For example, if four LEDs are provided in series in a street light and one of the LED fails, one aspect of the current invention is that the remaining three operational LEDs would continue to provide light. Rather than causing a complete loss of light, the street light would provide 75% of normal light output.

A second aspect of the invention is that, at the same time, the minimum extra energy (close to none) is expended to shunt the non working LED. Thus, if the circuit was using, for example, 4 LEDs of 7 watts each and thereby consuming 28 watts all together, after failure of one LED the circuitry will still a) operate with 3 remaining LEDs (automatically); and b) consume ~3×7 watts=21 watts as a result of the failure.

The cost of the solution is relatively low and it can also be applied to groups of LEDs as well as to each single LED.

DESCRIPTION OF INVENTION

Led with Bypass Circuit

The term "positive terminal" and "negative terminal" refer to any wire, circuit trace, or other connection to a power source and ground.

The term "thyristor" refers to a single component or to circuitry which provides the behavior of a thyristor.

The term "Zener Diode" refers to a single component or to circuitry which provides the behavior of a Zener Diode by having a first state with low voltage across the circuit, and a second state where increased voltage across the circuit triggers a thyristor.

Figure 1A:
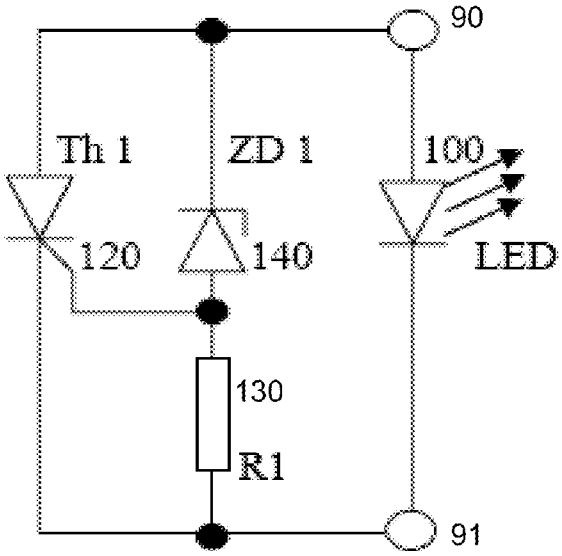
FIG. 1A is a schematic of a single LED and bypass circuit.
Figure 1B:
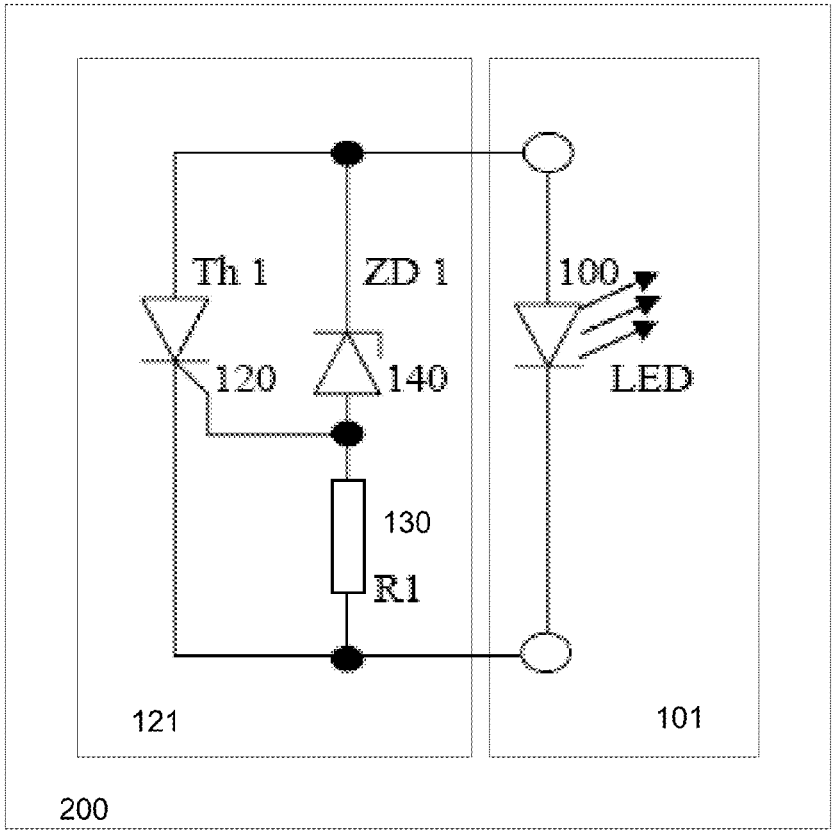
FIG. 1B is a schematic of the LED and bypass circuit of FIG. 1 showing a first LED circuit portion and a second bypass circuit portion.

FIG. 1A is a schematic of a single LED and bypass circuit of one embodiment of the current invention. FIG. 1B is a schematic of the "LED and bypass circuit" 200 of FIG. 1 showing a first LED circuit portion 101 and a second bypass circuit portion 121.

The LED circuit portion 101 includes an LED 100 which is positioned between a positive terminal 90 and a negative terminal 91.

The bypass circuit portion 121 is provided in parallel to the LED circuit portion and includes a first portion with a Zener Diode 140 in series with a resistor 130; and a second portion with a thyristor 120.

When the LED is operational, the voltage across the Zener Diode 140 remains below its zener voltage, and the thyristor 120 is not triggered.

When an LED fails, the voltage across Zener Diode 140 increases above its zener voltage triggering the thyristor 120 which will remain triggered as long as current flows.

DESCRIPTION OF INVENTION

Continued Led Operation When One Led in a Series Fails

Figure 2A:
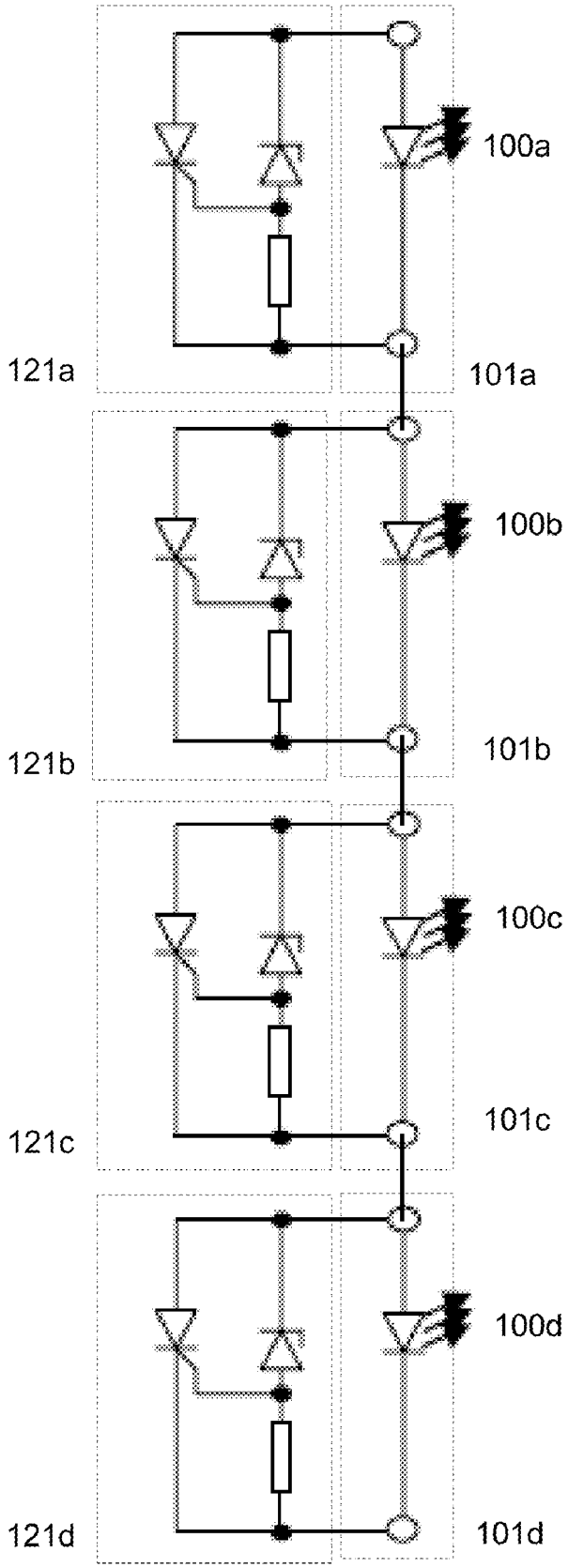
FIG. 2A is a schematic of a four LEDs and bypass circuits in series.

FIG. 2A is a schematic of a four LEDs 100*a*, 100*b*, 100*c*, and 100*d* and bypass circuits 121*a*, 121*b*, 121*c*, and 121*d* in series.

Figure 2B:
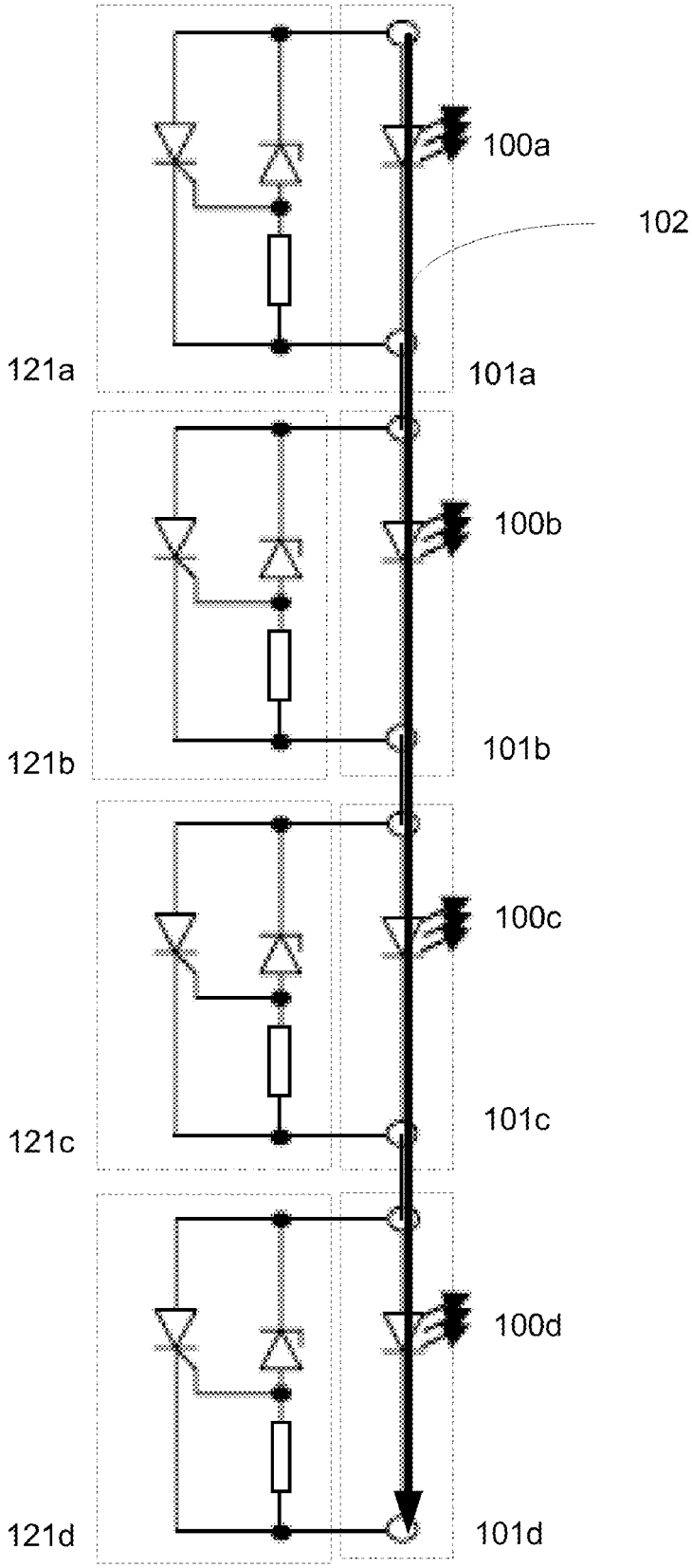
FIG. 2B is a schematic of the four LEDs and bypass circuits of FIG. 2A showing a normal current path when all four LEDs are functional.

FIG. 2B is a schematic of the four LEDs and bypass circuits of FIG. 2A showing a normal current path 102 when all four LEDs are functional.

Figure 2C:
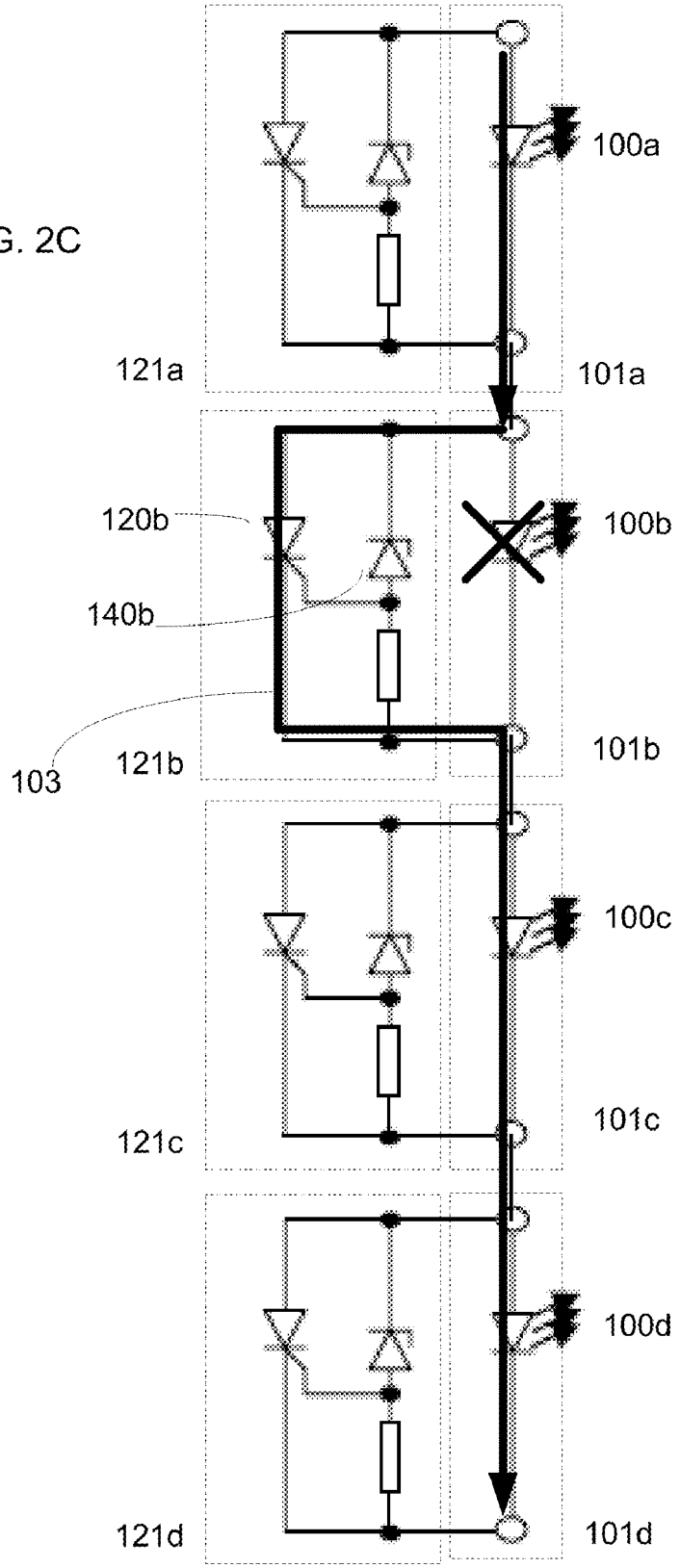
FIG. 2C is a schematic of the four LEDs and bypass circuits of FIG. 2A showing a current path when one of the LEDs is non-functional.

FIG. 2C is a schematic of the four LEDs and bypass circuits of FIG. 2A showing a current path 103 when LED 100*b* is non-functional. When LED 100*b* fails, the the voltage across Zener Diode 140*b* increases above its zener voltage triggering the thyristor 120*b* which will remain triggered as long as current flows.

A thyristor gets triggered by over-voltage on either the LED or the group of LEDs and shunts for either the cycle, in case of half cycle operation, or pulse width modulation, or the duration of the LED array being energized.

Benefits

One benefit of the current invention is safety-lights may get dimmer but not fail and still produce a safer environment rather than no light in mission critical applications.

The savings in maintenance when applied to applications such as street, car parking and path lights is large as maintenance can be scheduled rather than much more costly ad hoc repair.

EXAMPLE 1

Circuitry Provided With Each LED

In this example, the bypass circuit may be provided with each LED as a single unit.

EXAMPLE 2

Circuitry Provided as Integrated Circuit

In this example, the bypass circuit may be provided as an integrated circuit that is subsequently wired in parallel to each LED.

EXAMPLE 3

Discrete Components

In this example, the bypass circuit may be provided as discrete components, such as on a circuit board, that are subsequently wired in parallel to each LED.

EXAMPLE 4

Other Numbers of LEDs in Series

In the embodiment above, a series of 4 LEDs is provided. In other examples, other numbers of LEDs and bypass circuits may be provided in series.

What is claimed is:

1. An LED lighting system comprising:

a first LED and bypass circuit, the first LED and bypass circuit comprising:

a first LED circuit portion having a first LED between a first positive and a first negative terminal; and a first bypass circuit portion provided in parallel to the first LED circuit portion, the first bypass circuit portion having:

a Zener Diode, said Zener diode having an anode and a cathode, wherein said cathode is electrically coupled with a gate of a thyristor, wherein said anode of said Zener diode is electrically coupled to:

an anode of said thyristor; and said positive terminal;

a resistor, said resistor having a first and a second end, said first end electrically coupled to said cathode of said Zener diode and said second end electrically coupled to:

a cathode of said thyristor; and said negative terminal.

2. The LED lighting system of claim 1 wherein the LED circuit portion and the bypass circuit portion are provided as a single component.

3. The LED lighting system of claim 1 wherein the bypass circuit portion is provided as an integrated circuit.

4. The LED lighting system of claim 1 wherein the bypass circuit portion is provided as discrete components.

5. The LED lighting system of claim 1 wherein the LED and the discrete components of the bypass circuit portion are mounted on a circuit board.

6. The LED lighting system of claim 1 further comprising a second LED and bypass circuit, the second LED and bypass circuit comprising:

a second LED circuit portion having a second LED between a second positive and a second negative terminal, wherein said second positive terminal is electrically coupled to said first negative terminal; and a second bypass circuit portion provided in parallel to the second LED circuit portion, wherein the second bypass circuit is substantially the same as said first bypass circuit.

7. The LED lighting system of claim 6 wherein the LED and bypass circuit is provided in series with the second LED and second bypass circuit.

8. The LED lighting system of claim 7 further comprising a third and a fourth LED and bypass circuit provided in series with the first and second LED and bypass circuits, wherein the third LED and bypass circuit comprises:

a third LED circuit portion having a third LED between a third positive and a third negative terminal, wherein said third positive terminal is electrically coupled to said second negative terminal; and a third bypass circuit portion provided in parallel to the third LED circuit portion, wherein the third bypass circuit is substantially the same as said first bypass circuit; and wherein the fourth LED and bypass circuit comprises:

a fourth LED circuit portion having a fourth LED between a fourth positive and a fourth negative terminal, wherein said fourth positive terminal is electrically coupled to said third negative terminal; and a fourth bypass circuit portion provided in parallel to the fourth LED circuit portion, wherein the fourth bypass circuit is substantially the same as said first bypass circuit.

9. A method of controlling a plurality of LEDs in series, the method comprising:

providing a plurality of LEDs in a series circuit, providing a bypass circuit portion in parallel to each LED, the bypass circuit portion having:

a Zener Diode, said Zener diode having an anode and a cathode, wherein said cathode is electrically coupled with a gate of a thyristor, wherein said anode of said Zener diode is electrically coupled to:

an anode of said thyristor; and said positive terminal;

a resistor, said resistor having a first and a second end, said first end electrically coupled to said cathode of said Zener diode and said second end electrically coupled to:

a cathode of said thyristor; and said negative terminal;

operating the plurality of LEDs in a full-capability mode where each LED is operational; and upon the failure of an LED, shunting the failed LED with the bypass circuit portion, thereby providing current to all functional LEDs in the series circuit.

10. The method of claim 9 wherein shunting the failed LED with the bypass circuit further comprises:

increasing the voltage across the Zener Diode;

triggering the thyristor; and maintaining the thyristor in a triggered mode as long as current flows through a series circuit.

* * * * *